United States Patent [19]

Leger

[11] Patent Number: 4,709,232

[45] Date of Patent: Nov. 24, 1987

[54] MATRIX TRANSCODING SYSTEM IN VIDEOTEXT SYSTEMS

[75] Inventor: Alain A. Leger, Betton, France

[73] Assignee: Etablissement Public de Diffusion dit Telediffusion de France, France

[21] Appl. No.: 562,431

[22] Filed: Dec. 16, 1983

[30] Foreign Application Priority Data

Dec. 29, 1982 [FR] France ..... 82 22225

[51] Int. Cl.[4] ..... G09G 1/06

[52] U.S. Cl. ..... 340/731; 340/735; 340/748; 340/790

[58] Field of Search ..... 340/728, 731, 748, 800, 340/801, 735, 790; 364/518, 521; 358/287; 382/47

[56] References Cited

U.S. PATENT DOCUMENTS

| | | | |
|---|---|---|---|
| 3,976,982 | 8/1976 | Eiselen | 382/47 |
| 4,090,188 | 5/1978 | Suga | 340/731 |
| 4,153,896 | 5/1979 | White | 340/731 |
| 4,242,678 | 12/1980 | Somerville | 340/728 |
| 4,412,252 | 10/1983 | Moore et al. | 340/731 |
| 4,447,882 | 5/1984 | Walz | 382/47 |
| 4,479,119 | 10/1984 | Sakano | 340/731 |
| 4,532,602 | 7/1985 | Du Vall | 340/731 |

*Primary Examiner*—Gerald L. Brigance
*Assistant Examiner*—Jeffery A. Brier
*Attorney, Agent, or Firm*—Laff, Whitesel, Conte & Saret

[57] ABSTRACT

A system for transcoding signals for a 12×10 dot matrix into signals for a 8×10 dot matrix uses a two phase conversion process. In the first phase, the pixels of each line are arranged in groups of three and in their natural order. Each group of three pixels is logically processed to obtain a group of two converted pixels. In the second phase, the configuration of the initial four pixel block which straddles the limit or interspace between two three-pixel groups are analyzed. Depending on the difference found during the analysis, the two pixels which are converted in the first phase are kept on either side of the limit, or are replaced by either the corresponding converted pixels of the former line or the pixels that are calculated in the second phase.

7 Claims, 14 Drawing Figures

LOGICAL PROCESSING CIRCUIT
19
19.1
19.2
19.3
39
40
DOWNWARD SHIFT REGISTERS
15
16
2
3
4
5
6
7
4
5
6
7
RAM MEMORY

MATRIX TRANSCODING SYSTEM IN VIDEOTEXT SYSTEMS

The present invention relates to a transcoding system for changing primary matrixes having 12×10 dots into primary matrixes having 8×10 dots, and vice versa, in dynamically redefinable character and matrix videotext systems.

Alpha mosaic or matrix videotext systems are known, such as for instance, the French "Teletel" and "Antiope" systems or the British "Prestel" and "Ceefax" systems. As opposed to these systems, the Canadian "Telidon" system is an alpha geometrical graph showing which would not be likely to use the present invention.

Dynamically redefinable character and matrix videotext systems are known. For instance, such a system is described in the U.S. Pat. No. 4,290,062. In the character generator of the terminal units of each of these systems, a character shape RAM is associated with the usual ROM's. The terminal units may receive specific character shapes which are normally transferred to them through the videotext data transmission channel. These specific character shapes supplement the sets of character shapes which are already stored in the ROM's. Such systems are called "DRCS systems" (dynamically redefinable character set). Presently there are two types of DRCS structures. In one type, the primary matrixes have 8×10 dots, and, in the other type, they have 12×10 dots. With regard to DRCS systems, reference will be generally made to the paper of O. Lambert et al., published in the technical review "IEEE Transactions on Consumer Electronics", Vol. CE26, August 1980, pages 600–604, entitled "ANTIOPE AND D.R.C.S.".

Efforts are presently being made for defining a method for allowing the two DRCS structures to make compatible signal conversions with a minimum of distortion. A Swedish transcoding scheme called a "Common Coding Schemes for 8 and 12 Dot DRCS" was proposed at the CEPT videotext meeting held at Darmstadt on Mar. 25–27, 1981. However, utilization of such a conversion system seems to result in considerable distortions of the initial shapes.

An object of the present invention is to provide a transcoding system causing only small distortions and which can be implemented by simple means so that the cost of the terminal unit is not substantially increased.

According to a feature of this invention, a system is provided for transcoding a 12×10 dot matrix into an 8×10 dot matrix. The conversion comprises two phases. In the first phase, the initial pixels of each 12 dot line are arranged in groups of three, in their natural order. Each group of three pixels is logically processed to obtain a group of two converted pixels. A second phase conversion is used to reduce the thickness of the lines at the boundries of the two-pixel groups. In the second phase, the configuration of the initial 4 pixel-block or "boundary block" which straddles or spans the limit or interspace between two adjacent initial three pixel groups is analyzed. When the boundary block is different from 0110, the two pixels converted in the first phase which are on opposite sides of the boundary are retained unchanged. However, when the four boundary pixel block is 0110, the configuration of the initial four pixel boundary block belonging to the preceding line is analyzed, with the following results:

When the previous line's boundary block is found to be equal to 0110, the pixels of the converted block are replaced by the corresponding definitely converted pixels of the preceding line.

When the previous line's boundary block is different from either 0110 or 0000, the pixels of the converted block are replaced by the pixels which are calculated in the second phase from the initial pixels and adjacent pixels located in the current line and the preceding line.

When the previous line's boundary block is equal to 0000, the corresponding initial four-pixel block in the next line is analyzed, and:

When the corresponding boundary block in the next line is equal either to 0000 or 0110, the pixels of the converted block are replaced by 1 and 1.

When the corresponding boundary block in the next line is different from either 0000 or 0110, the pixels of the converted block are replaced by the pixels calculated in the second phase.

According to another feature of the invention, in the logical processing of the first phase, the initial three pixels a, b, c, are converted into a two-pixel group of converted pixels $\hat{a}$, $\hat{b}$, according to the following logical formulae:

$$\hat{a}=a+(b_{-1}\cdot a_{-1}+\overline{c}_{-1}\cdot b_{-1})\cdot a\cdot b\cdot\overline{c}$$

$$\hat{b}=c+(c_{-1}\cdot b_{-1}+\overline{b}_{-1}\cdot\overline{a}_{-1})\cdot\overline{a}\cdot b\cdot\overline{c}$$

According to another feature of the invention, the pixels b and a', which are calculated in the second phase, are respectively defined either by the two following logical equations related to the previous line:

$$\hat{b}\cdot\overline{\hat{a}'}=a'_{-1}\cdot b'_{-1}\cdot(a_{-1}\cdot b_{-1}\cdot c_{-1}\cdot\overline{c}'_{-1}+\overline{b}_{-1}\cdot c_{-1}+b_{-1}\cdot\overline{c}_{-1})+\overline{a}'_{-1}\cdot\overline{b}'_{-1}\cdot(c_{-1}\cdot c'+b_{-1}\cdot\overline{c}_{-1})+\overline{b}_{-1}\cdot\overline{c}_{-1}\cdot a'_{-1}\cdot\overline{a} \quad \text{(I)}$$

and $$\overline{\hat{b}}\cdot\hat{a}'=b_{-1}\cdot c_{-1}\cdot(\overline{a}_{-1}\cdot a'_{-1}\cdot b'_{-1}\cdot c'_{-1}+a'_{-1}\cdot\overline{b}'_{-1}+\overline{a}'_{-1}\cdot b'_{-1})+\overline{b}_{-1}\cdot\overline{c}_{-1}\cdot(a'_{-1}\cdot a+\overline{a}'_{-1}\cdot b'_{-1})+c_{-1}\cdot\overline{a}'_{-1}\cdot\overline{b}'_{-1}\cdot\overline{c}' \quad \text{(II)}$$

or by two equivalent logical equations (I') and (II'), related to the next line, in which minus (−) has been changed to plus (+).

According to another feature of the invention, a converting circuit is provided which operates according to the system of the invention and comprises a digital signal input of a 12×10 dot matrix. The converting circuit is connected to the input of a set of three serially mounted upward 12-stage shift registers. The outputs of the first and second upward 12-stage shift registers are connected to the corresponding inputs of a first phase processing circuit.

A digital signal output of a 8×10 dot matrix is connected to the output of a set of three serially mounted downward 8-stage shift registers. The outputs of the first phase processing circuit are connected to the parallel inputs of the first downward 8-stage shift register. The parallel outputs of the second upward 12-stage shift register are connected to the corresponding inputs of a second phase processing circuit. The parallel outputs of the first and third upward 12-stage shift registers are connected to the corresponding inputs of the second phase processing circuit through an inverter circuit.

The parallel outputs, of the third downward 8-stage shift register except for the first and last, are connected to the corresponding inputs of the second phase processing circuit. The outputs of the second phase processing circuit are connected to the parallel inputs of the second downward 8-stage shift registers, except for the first input and the last input. A time base or clock circuit controls the operation of the first phase processing circuit and the second phase processing circuits, and the clocking of the shift registers.

The above mentioned and other features of the present invention will appear more clearly from the following description of a particular embodiment, the description being made in conjunction with the accompanying drawings, wherein.

Figure 1:
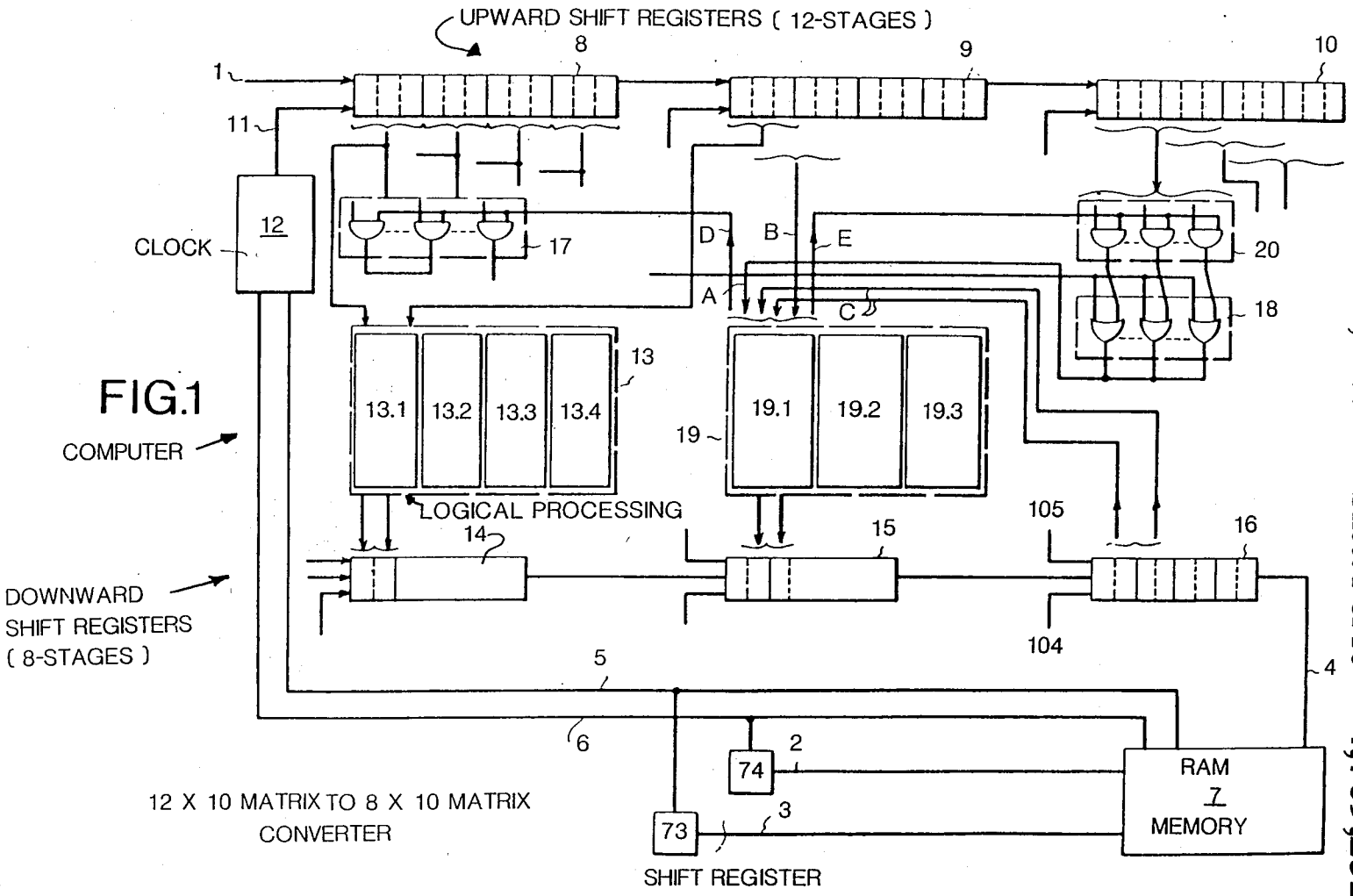
FIG. 1 is a schematic block-diagram of a conversion circuit according to this invention.
Figures 2, 2A, 2B, 2C, 2D:
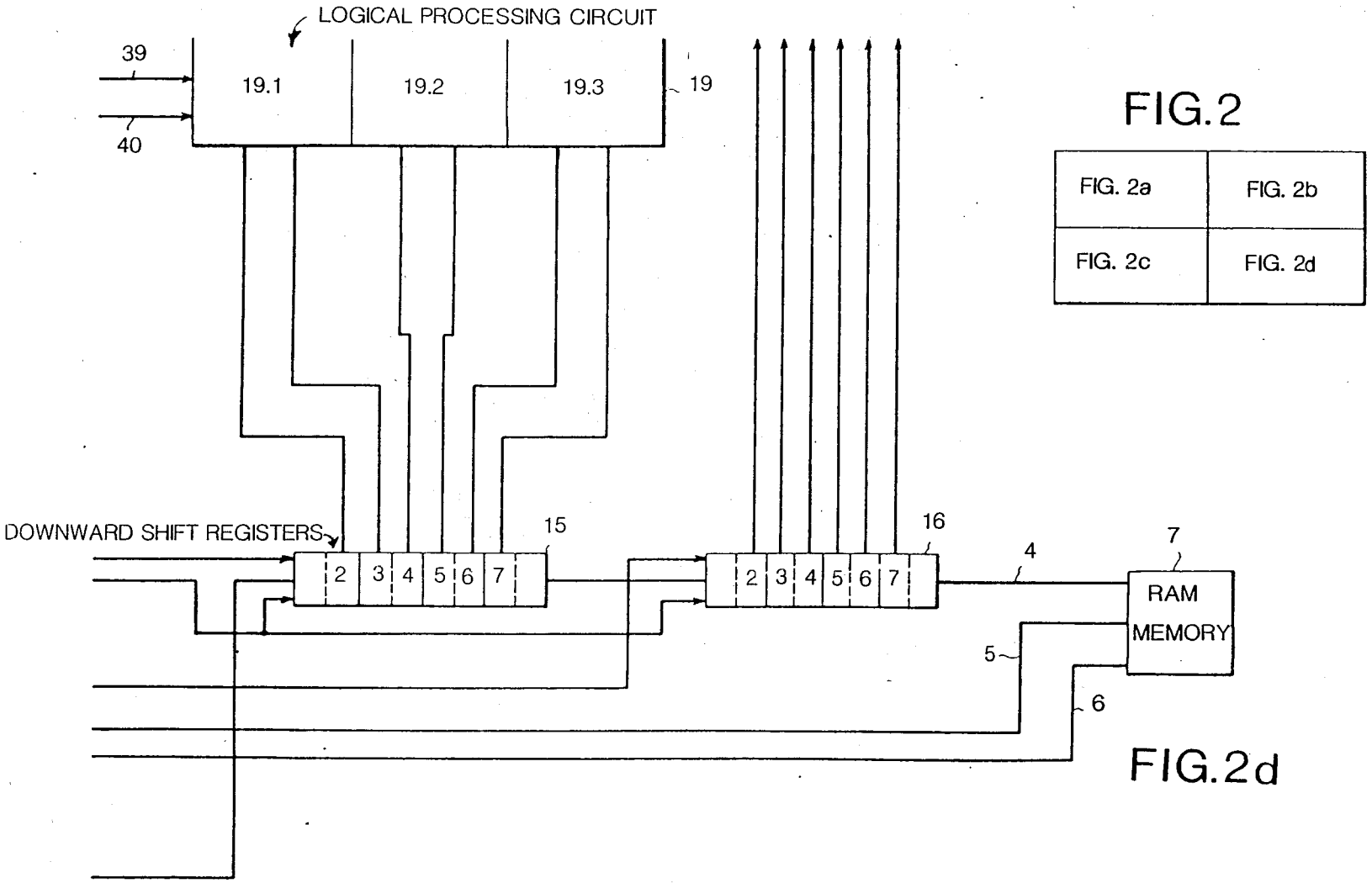
FIG. 2 illustrates the arrangement of FIGS. *2a–2d.*
Figure 2A:
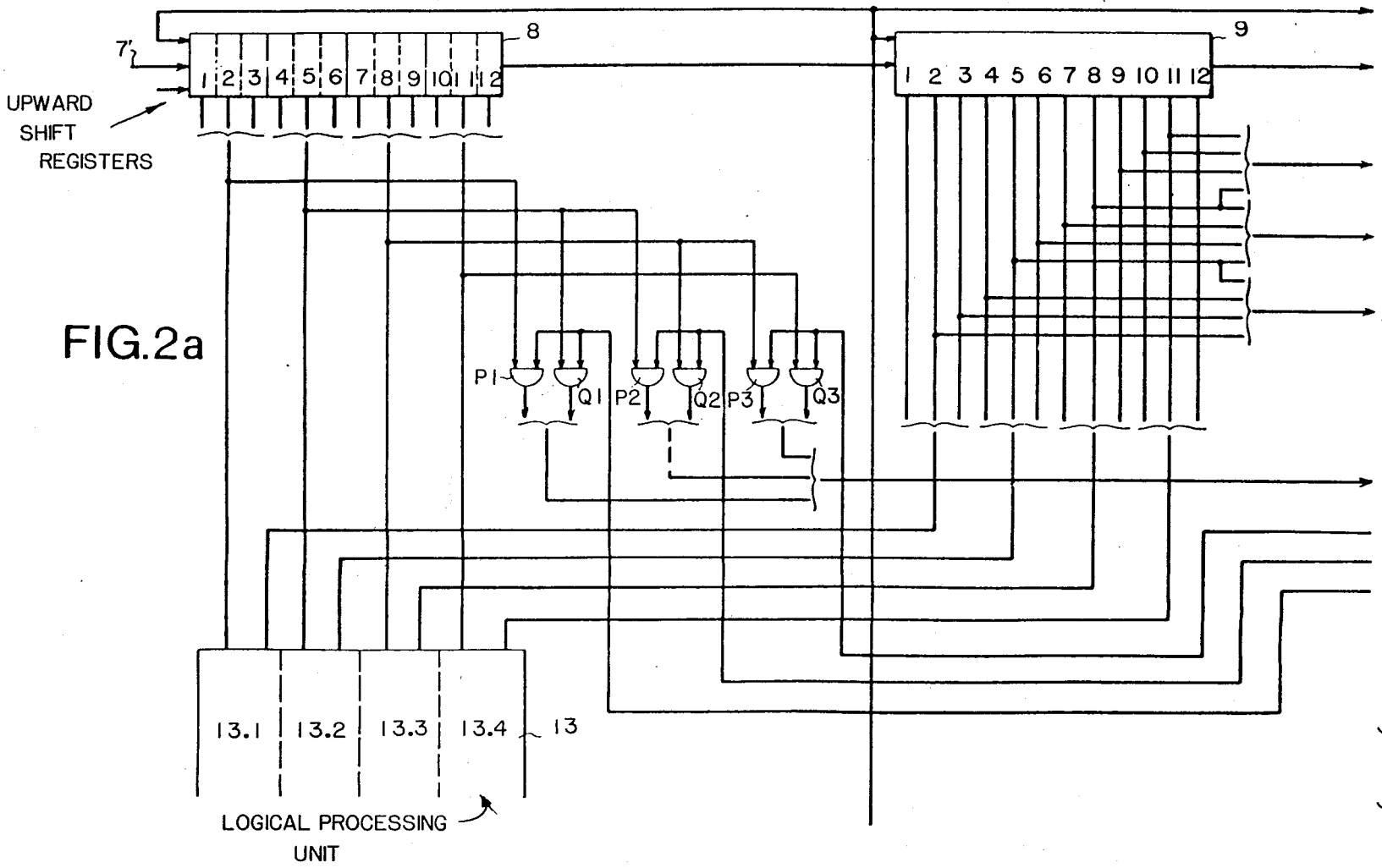
Figure 2B:
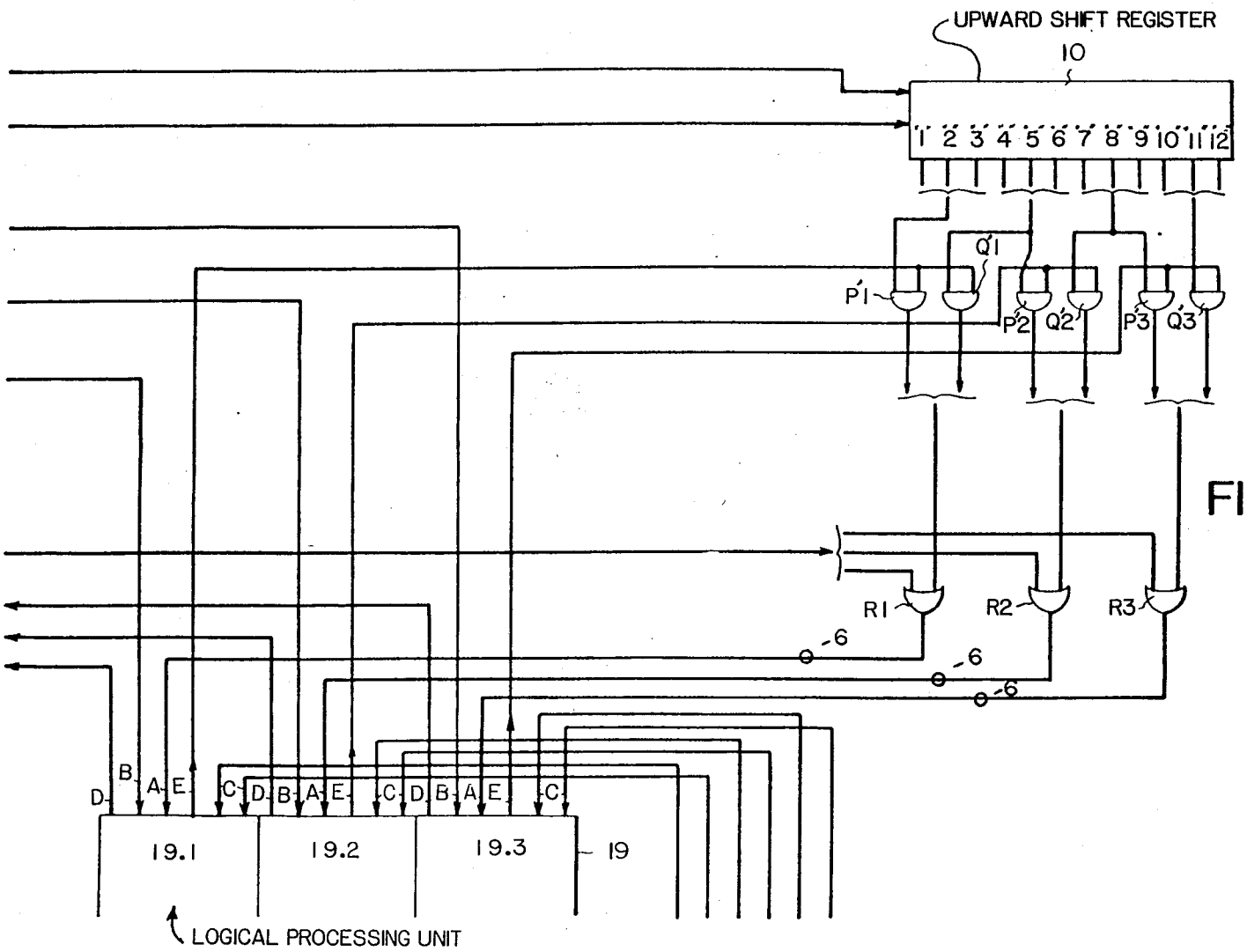
Figure 2C:
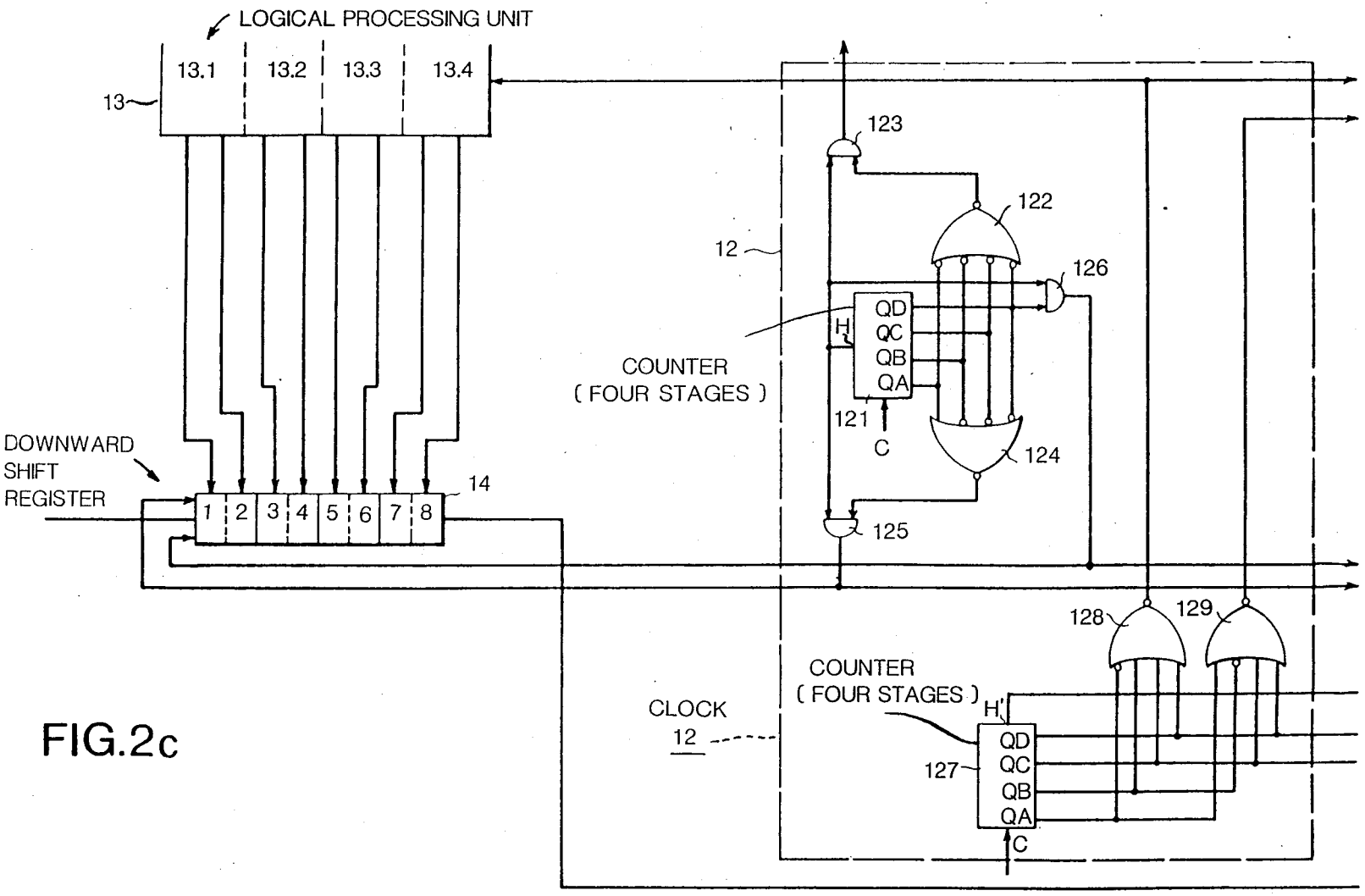
Figure 5:
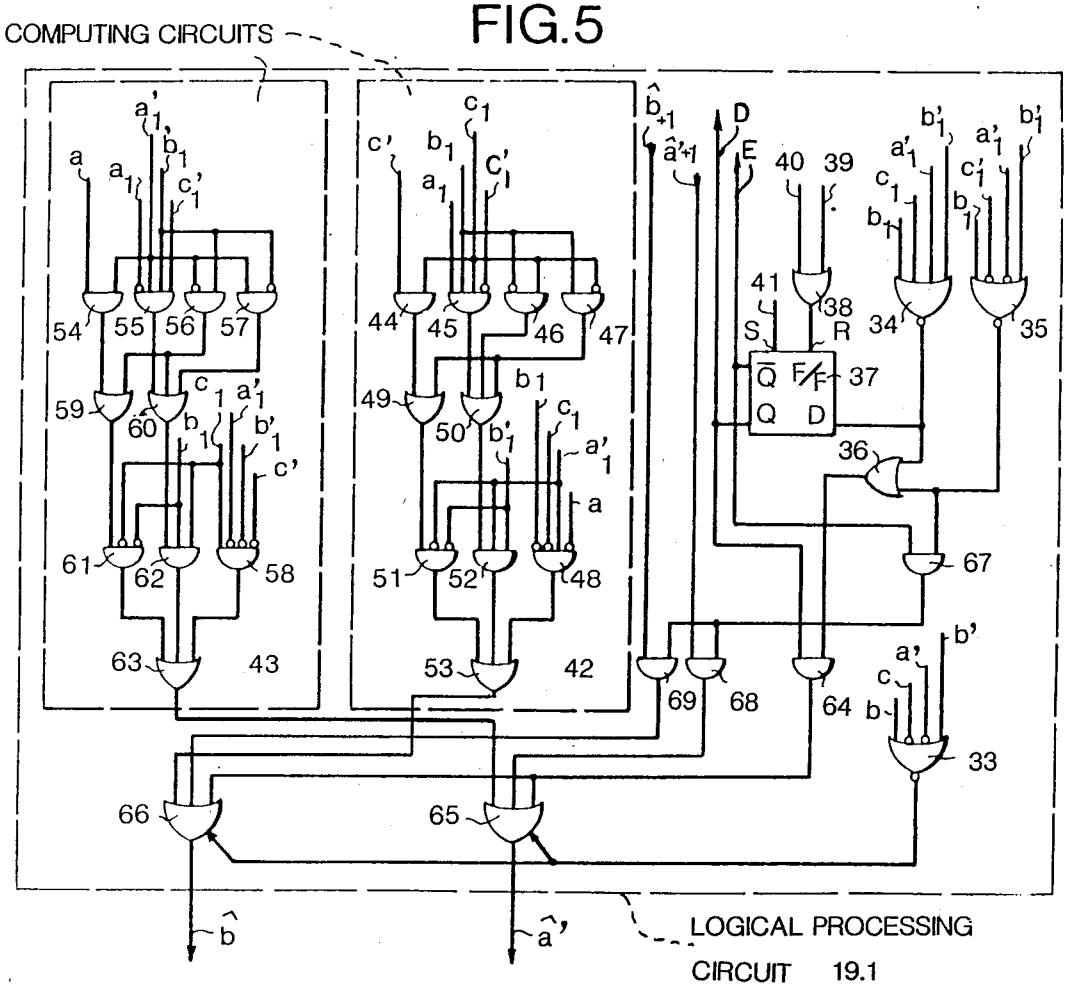
Figure 4:
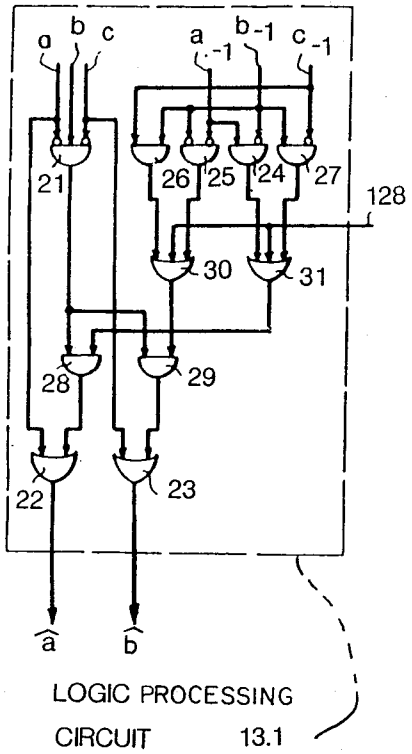
Figure 6:
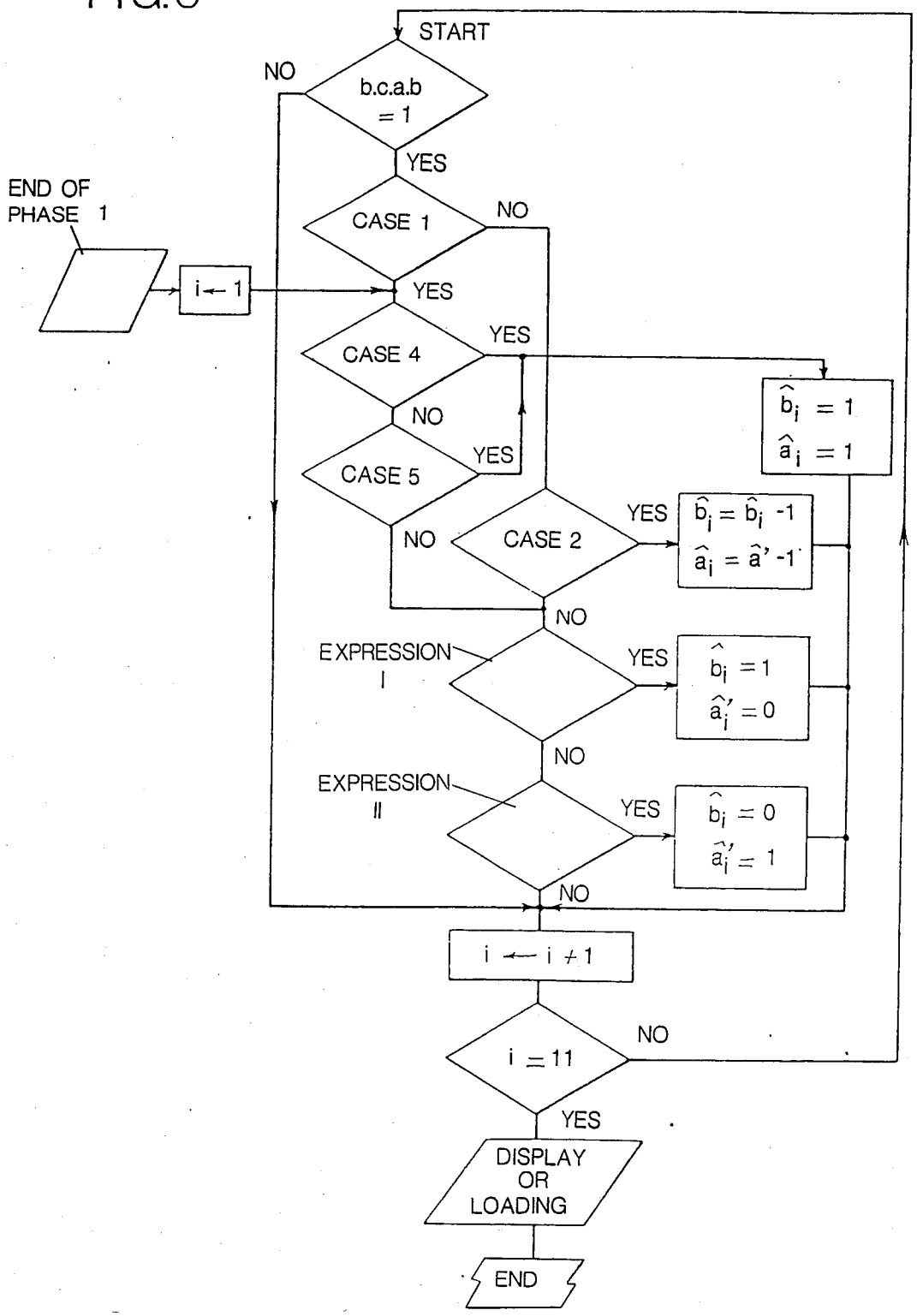
Figure 7:
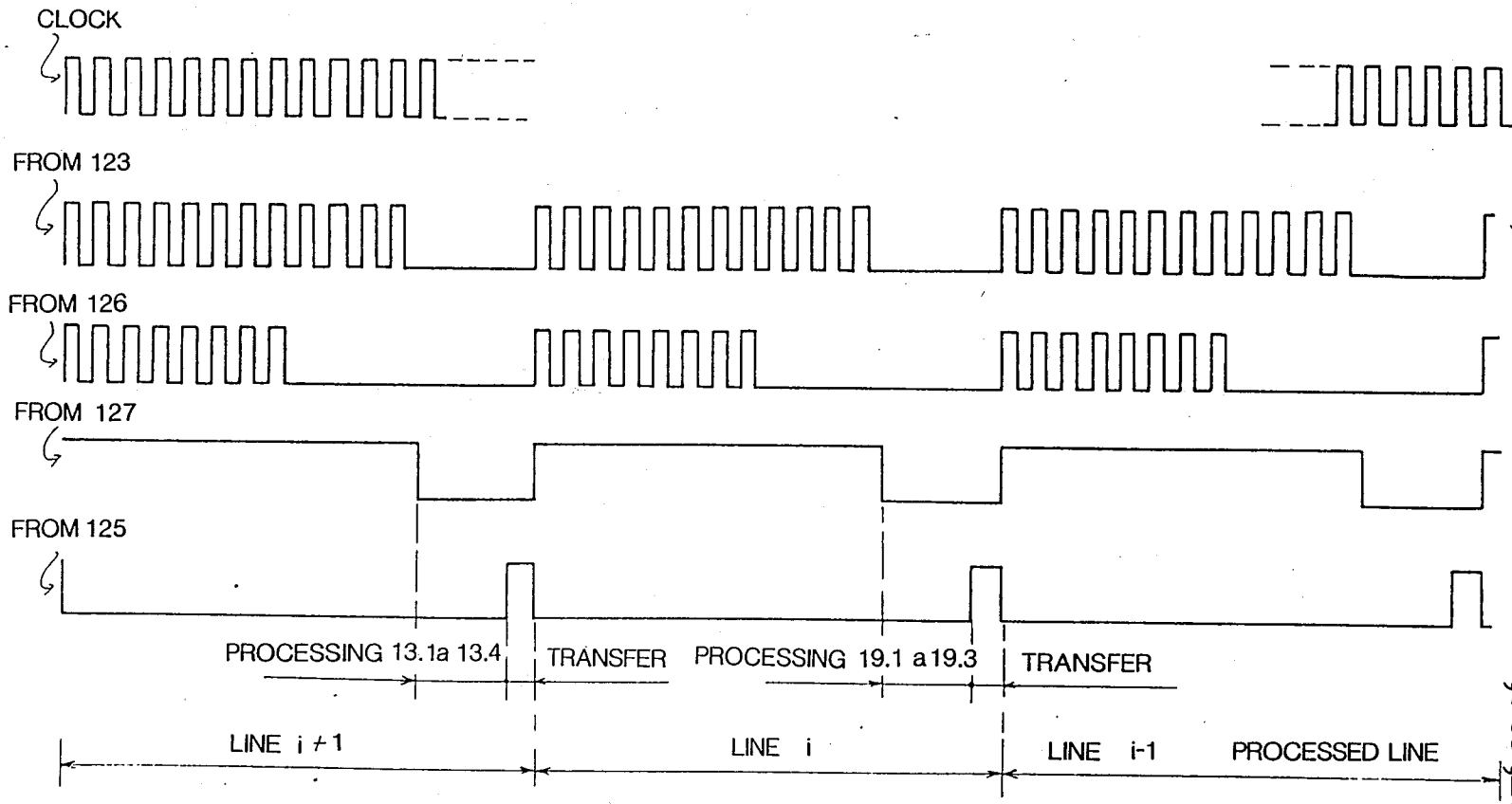
Figure 9:
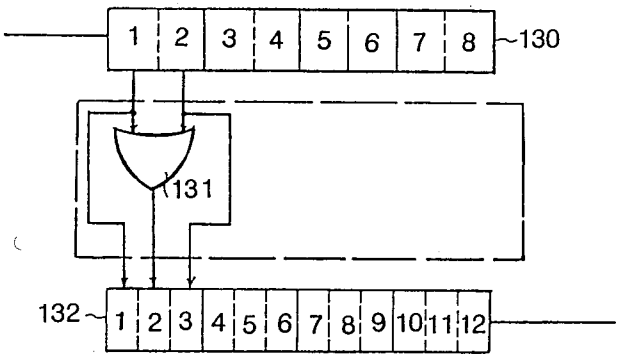
Figure 8:
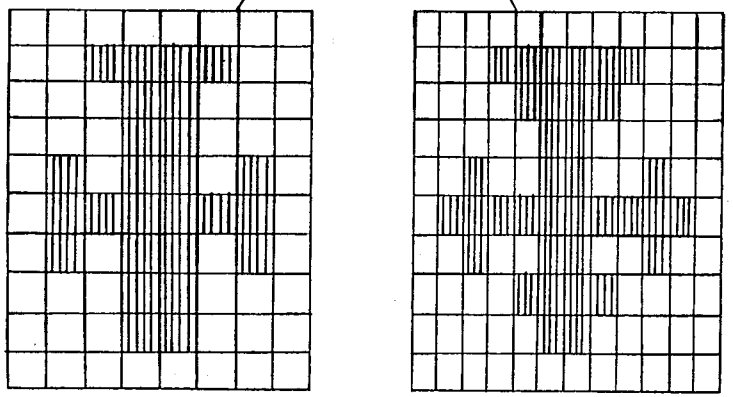

FIGS. *2a–2d,* assembled as shown in FIG. 2, are block-diagrams of the different parts of the conversion circuit shown in FIG. 1;

FIGS. *3a* and *3b* are diagrams illustrating the operation of the circuits shown in FIGS. 1 and 2;

FIG. 4 is a diagram of the first phase processing circuit;

FIG. 5 is a diagram of the second phase processing circuit;

FIG. 6 is a flow-diagram illustrating the operation of the processing circuit shown in FIG. 5;

FIG. 7 illustrates waveforms of the output signals of the time base shown in FIGS. 1 and 2;

FIG. 8 is an example of a conversion of a 12×10 dot matrix into a 8×10 dot matrix; and FIG. 9 is a diagram for the conversion of a 8×10 dot matrix into a 12×10 dot matrix.

Three data are needed for writing the new shape of a character into a RAM memory: The first datum is the address of the unitary matrix in the memory. The second datum is the address of the line in the matrix. The third datum relates to the bits constituting the line. In U.S. Pat. No. 4,290,062, FIG. 7, those three data are the bits transmitted through wires 83, 84 and 85 to the RAM memory 37, those three wires constituting the link 80. The transcoding circuit according to the present invention is to be used with the teletext system described in the above mentioned patent. The transcoding system is mounted in series with the link 80.

This application's FIG. 1 shows a somewhat simplified block diagram of the 12-to-8, converter assembly. The input wires of the transcoding circuit comprise the wires 1, 2 and 3, which respectively correspond to U.S. Pat. No. 4,290,062's wires 85, 84 and 83. The present invention's output wires 4, 5 and 6 are connected to a character RAM memory 7 corresponding to memory 37 in the above mentioned U.S. Patent.

FIG. 1's input wire 3 is connected to the input of a shift register 73 in which the character address is delayed by a time period corresponding to the processing of the first three lines of the character. The signal on output wire 5, issuing from a control logic circuit or clock 12, ensures the synchronization of shift register 73.

Input wire 2 is connected to the input of a shift register 74 in which each received line address is delayed by a time period corresponding to the time required for processing those characters' lines. The signal on output wire 6 issuing from the clock circuit 12 ensures synchronization of register 74.

Input wire 1 is connected to a data input register 8 of which the series output is connected to the data input of a shift register 9. The series output of the shift register 9 is connected to the data input of a shift register 10. Each register 8, 9 and 10 has twelve stages. Therefore, each register is able to store one matrix line. The clock inputs of those registers are connected to receive the ouput 11 of clock circuit 12. Practically, circuits of the type sold with the reference "DM 74 195" may be used for registers 8–10.

Referring to FIG. *2a,* parallel outputs "1", "2" and "3" of register 8 are connected to the corresponding inputs of a first logic processing circuit 13.1. Register 8's parallel outputs "4", "5" and "6" are connected to the corresponding inputs of a second logic processing circuit 13.2, and its outputs "7", "8" and "9" are connected to the corresponding inputs of a third logic processing circuit 13.3. Parallel outputs "10", "11" and "12" are connected to the corresponding inputs of a fourth logic processing circuit 13.4. The processing circuits 13.1, 13.2, 13.3 and 13.4 are identical and constitute a converting circuit 13 in which groups of three pixels are converted into groups of two pixels.

In the same manner, the parallel outputs of a register 9: "1", "2", "3", "4", "5", "6", "7", "8", "9"; "10", "11", "12" are respectively connected to the corresponding inputs of the circuits 13.1, 13.2, 13.3, 13.4.

Referring to FIG. *2c,* circuit 13.1 has two outputs which are respectively connected to the parallel inputs "1" and "2" of an 8-stage shift register 14. Circuit 13.2 has two outputs which are respectively connected to the parallel inputs "3" and "4" of shift register 14. Circuit 13.3 has two outputs which are respectively connected to the parallel inputs "5" and "6" of the shift register 14. Circuit 13.4 has two outputs which are respectively connected to the parallel inputs "7" and "8" of shift register 14. As shown in FIG. *2d,* the series output of register 14 is connected to the input of another 8-stage shift register, register 15. The series output of register 15 is connected to the series input of still another register, 8-stage shift register 16, whose output is connected to an output wire 4.

Register 8 (FIG. *2a*) also has its parallel outputs "1" to "3" respectively connected to the first inputs of three AND gates P1. Parallel outputs "4" to "6" of register 8 are respectively connected, on one hand, to the first inputs of three AND gates Q1, and on the other hand, to the first inputs of three AND gates P2. Parallel outputs "7" to "9" of register 8 are respectively connected, on one hand, to the first inputs of three AND gates Q2, and, on the other hand, to the first inputs of three AND gates P3. Finally, three parallel outputs "10" to "12" of register 8 are connected to the first inputs of three AND gates Q3. The AND gates P1–P3 and Q1–Q3 constitute a switch 17.

As shown in FIG. *2a,* the outputs of AND gates P1 and Q1 are respectively connected to the first inputs of six OR gates R1 (FIG. *2c*)—only a representative one of the six gates is shown. The outputs of the AND gates P2 and Q2 are respectively connected to the first inputs of six OR gates R2. The outputs of the AND gates P3 and Q3 are respectively connected to the first inputs of six OR gates R3. The OR gates R1–R3 constitute a link circuit 18.

The outputs of the six OR gates R1 are connected to the corresponding inputs A1–A6, collectively called A, of a logic processing circuit 19.1. The outputs of the six OR gates R2 are connected to the corresponding inputs A of the logic processing circuit 19.2. The outputs of the six OR gates R3 are connected to the corresponding inputs A of the third logic processing circuit 19.3. The circuits 19.1–19.3 are identical and constitute a processing circuit 19.

As shown in FIG. 2*d*, circuit 19.1 has two outputs which are respectively connected to the parallel inputs "2" and "3" of a register 15. Similarly, circuit 19.2 has two outputs which are connected to parallel inputs "4" and "5" of register 15. Circuit 19.3 has two outputs which are respectively connected to parallel inputs "6" and "7" of the register 15.

On the other hand, FIG. 2*b* shows that circuit 19.1 has inputs B which are respectively connected from FIG. 2*a*'s parallel outputs "2", "3", "4" and "5" of register 9. Likewise, circuit 19.2 has inputs B respectively connected from parallel outputs "5", "6", "7" and "8" of register 9. And circuit 19.3 has inputs B respectively connected from outputs "8", "9", "10" and "11" of register 9.

FIG. 2*b* shows that circuit 19.1 also has inputs C respectively connected from FIG. 2*a*'s parallel outputs "2" and "3" of register 16. Similarly, circuit 19.2 has inputs C respectively connected from parallel outputs "4" and "5" of register 16, and circuit 19.3 has inputs C from the parallel outputs "6" and "7" of register 16.

Finally, FIG. 26 shows that circuit 19.1 has an output D which is connected (FIG. 2*a*) to the second inputs of the gates P1 and Q1. Circuit 19.2 in turn, has an output D connected to the second inputs of the gates P2 and Q2, and circuit 19.3 has an output D connected to the second inputs of the gates P3 and Q3.

Upward shift register 10 (FIGS. 1 and 2*b*) has parallel outputs "1" to "3" respectively connected to the first inputs of three AND gates P'1. Its parallel outputs "4" to "6" are respectively connected, on one hand, to the first inputs of three AND gates Q'1, and, on the other hand, to the first inputs of three AND gates P'2. Its three parallel outputs "7" to "9" are respectively connected, on one hand, to the first inputs of three AND gates Q'2, and, on the other hand, to the first inputs of three AND gates P'3. Its three parallel outputs "10" to "12" are connected to the first inputs of three AND gates Q'3. The AND gates P'1–P'3 and Q'1–Q'3 constitute a switch 20.

Switch 20's AND gates P'1 and Q'1 have outputs respectively connected to the second inputs of the six OR gates R1, only a representative one of the six gates being shown. Switch 20's AND gates P'2 and Q'2 have outputs respectively connected to the second inputs of OR gates R2, and AND gates P'3 and Q'3 are respectively connected to the second inputs of six OR gates R3.

FIG. 2*b* shows that circuit 19.1 has an output E connected to the second inputs of the gates P'1 and Q'1. Similarly, circuit 19.2 has an output E connected to the second inputs of the gates P'2 and Q'2. Also, circuit 19.3 has an output E connected to the second inputs of the gates P'3 and Q'3.

Figures 3A, 3B:
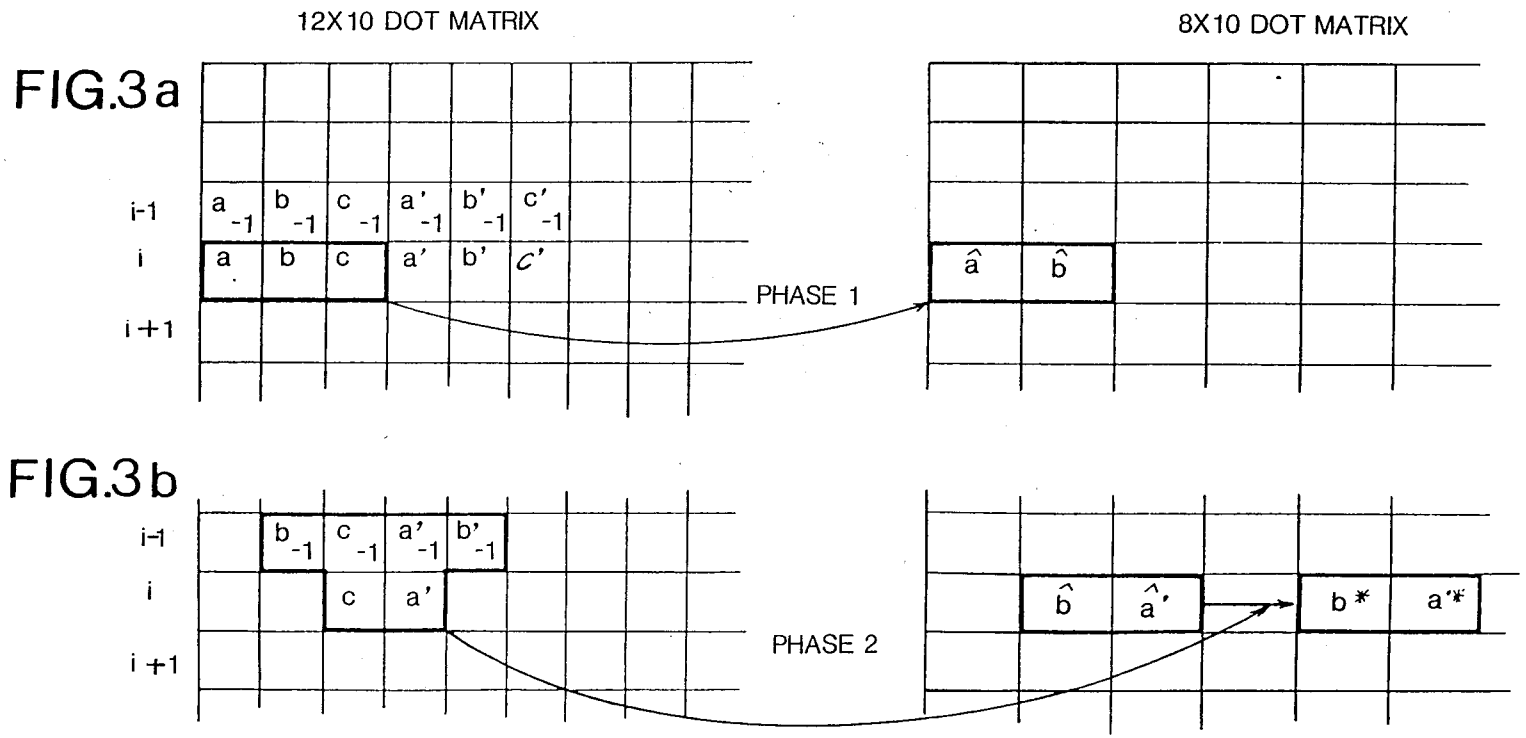

Reference will be now made to FIGS. 3*a* and 3*b* before making a detailed description of the logical processing circuits 13.1 and 19.1 (FIGS. 4 and 5). In FIG. 3*a*, the left side illustrates a part of a starting or initial $12\times10$ dot matrix, and the right side illustrates the tentatively converted part of a $8\times10$ dot matrix, after it has been passed through the circuit 13.1.

In the following description, such a preliminary conversion will be called "first phase" or "Phase 1" conversion. In Phase 1 the twelve pixels of a line i are arranged in four groups of three pixels: a, b, c; a', b', c'; etc. (FIG. 3*a*). Each group of three pixels is converted into a corresponding group of two pixels in the $8\times10$ dot matrix. Each line of the $8\times10$ matrix thus correspondingly comprises four groups of converted pixels: $\hat{a}$, $\hat{b}$; $\hat{a}'$, $\hat{b}'$; $\hat{a}''$, $\hat{b}''$; $\hat{a}'''$, $\hat{b}'''$.

More particularly, FIG. 3*a* shows a first group of three pixels a, b, c in the line i of the $12\times10$ dot matrix, followed by a second group of three pixels a', b', c' in the same line. The corresponding first group of three pixels $a_{-1}$, $b_{-1}$, $c_{-1}$ in prior line $(i-1)$, are followed by a corresponding second group of three pixels $a'_{-1}$, $b'_{-1}$, $c'_{-1}$. In the line i of the corresponding $8\times10$ dot matrix on the right, there are shown the corresponding groups of two pixels: the first group $\hat{a}$, $\hat{b}$ and the second group $\hat{a}'$, $\hat{b}'$.

FIG. 4 shows the detailed diagram of the logic processing circuit 13.1 that calculates the pixels a and b as functions of the adjacent pixels a, b, c, $a_{-1}$ $b_{-1}$ and $c_{-1}$, as follows:

$$\hat{a}=a+(\overline{b}_{-1}\cdot a_{-1}+\overline{c}_{-1}\cdot b_{-1})\cdot\overline{a}\cdot b\cdot\overline{c}$$

$$\hat{b}=c+(c_{-1}\cdot b_{-1}+\overline{b}_{-1}\cdot\overline{a}_{-1})\cdot\overline{a}\cdot b\cdot c$$

In the circuit 13.1, the references of the inputs are those of the pixel data to which they correspond. The input a is connected, on one hand, to the inverting input of an AND gate 21, and, on the other hand, to the input of an OR gate 22. The input b is connected to the non-inverting input of the AND gate 21. The input c is connected, on one hand, to the other inverting input of AND gate 21, and on the other hand to one input of an OR gate 23. The input $a_{-1}$ is connected, on one hand, to the direct input of an AND gate 24, and, on the other hand, to an inverting input of an AND gate 25. The input $b_{-1}$ is connected, on one hand, to inverting inputs of the gates 24 and 25, and, on the other hand, to direct inputs of AND gates 26 and 27. The input $c_{-1}$ is connected, on one hand, to a direct input of AND gate 26, and on the other hand to an inverting input of the AND gate 27.

The output of the AND gate 21 is connected to the first inputs of two AND gates 28 and 29. The outputs of the AND gates 25 and 26 are respectively connected to two inputs of a 3-input OR gate 30. The outputs of the AND gates 24 and 27 are respectively connected to two inputs of a 3-input OR gate 31. The outputs of the OR gates 30 and 31 are respectively connected to the second inputs of the AND gates 29 and 28.

The outputs of the AND gates 28 and 29 are respectively connected to the second inputs of the OR gates 22 and 23. The third inputs of the OR gates 30 and 31 are connected to the enabling input 128. The pixels $\hat{a}$ and $\hat{b}$ are supplied at the output of the OR gates 22 and 23 and, as shown in FIG. 2*c*, are transferred to the inputs "1" and "2" of the register 14, through the output wires of 13.1.

Obviously, the circuit 13.2 calculates the pixels $\hat{a}'$ and $\hat{b}'$ with the second groups of three pixels of the lines i and $(i-1)$, etc.

In the left-hand part of the FIG. 3*b*, there is shown a part of a $12\times10$ dot matrix, and, in the right-hand part, the converted part after the first phase, and the one after the second phase. In practice, the second phase conversion is necessary for reducing the thickness of the lines at the boundaries of the 2-pixel groups.

In the 12×10 dot matrix of FIG. 3*b*, consideration is given to the observation window which comprises the pixels c and a′ in the line i and the pixels $b_{-1}$, $c_{-1}$, $a'_{-1}$, $b'_{-1}$ in the line (i−1). In some cases, which will be defined in the following, the pixels belonging to that window will be used for eventually modifying the pixels $\hat{b}$ and $\hat{a}'$ resulting from Phase 1 processing in the circuits 13.1 and 13.2 in order to obtain the final pixels b and a′ resulting from the processing in the circuit 19.1.

The processing in the circuit 19.1 is started only when the configuration of the four initial boundary pixel b, c, a′, b′ is 0110. In this case, in the circuit 19.1 of FIG. 5, boundary pixels from the line (i−1) are taken into account, with eventually adjacent pixels from the prior line (i−1) or from the line (i+1), in order to determine the converted pixels $\hat{b}$ and $\hat{a}'$ of the line i. For every other configuration of initial boundary pixels b,c,a′,b′, the finally converted pixels $\hat{b}$ and $\hat{a}'$ are those which have been calculated in the circuits 13.1 and 13.2.

If we condsider the boundaries of adjacent initial lines, a number of cases or conditions may arise when (b,c,a′,b′)=0110:

(1) $b_{-1}, c_{-1}, a'_{-1}, b'_{-1}=0000$ (in prior line)
(2) $b_{-1}, c_{-1}, a'_{-1}, b'_{-1}=0110$ (in prior line)
(3) line i is the 1st line in the matrix
(4) $b_{+1}, c_{+1}, a'_{+1}, b'_{+1}=0000$ (in next line)
(5) $b_{+1}, c_{+1}, a'_{+1}, b'_{+1}=0110$ (in next line)
(6) cases where none of the conditions of cases (1) to (5) are present.

In the case (6), the converted $\hat{b}$ and $\hat{a}'$ are determined either by means of the "prior line" logical equations:

$$\hat{b}\cdot\hat{a}'=a'_{-1}\cdot b'_{-1}\cdot(a_{-1}\cdot b_{-1}\cdot c_{-1}\cdot\bar{c}'_{-1}+\bar{b}_{-1}\cdot c_{-1}+b_{-1}\cdot\bar{c}_{-1})+\bar{a}'_{-1}\cdot\bar{b}'_{-1}\cdot(c_{-1}\cdot c'+b_{-1}\cdot\bar{c}_{-1})+\bar{b}_{-1}\cdot\bar{c}_{-1}\cdot a'_{-1}\cdot\bar{a} \quad \text{(I)}$$

and $$\hat{b}\cdot\hat{a}'=b_{-1}\cdot c_{-1}\cdot(\bar{a}_{-1}\cdot a'_{-1}\cdot b'_{-1}\cdot c'_{-1}+a'_{-1}\cdot\bar{b}'_{-1}+\bar{a}'_{-1}\cdot b'_{-1})+\bar{b}_{-1}\cdot\bar{c}_{-1}\cdot(a'_{-1}\cdot a+\bar{a}'_{-1}\cdot b'_{-1})+c_{-1}\cdot\bar{a}'_{-1}\cdot\bar{b}'_{-1}\cdot\bar{c}' \quad \text{(II)}$$

or by means of the two equivalent "next line" logical equations (I′) and (II′), wherein minus (−) would be replaced by plus (+).

As FIG. 1 shows, when wire E is enabled, the data inputs of the circuit 19.1 are the 6-wire input A which receives the "prior line" pixel data $a_{-1}$, $b_{-1}$, $c_{-1}$, $a'_{-1}$, $b'_{-1}$, $c'_{-1}$. When the wire D is enabled, input A receives the "next line" pixel data $a_{+1}$, $b_{+1}$, $c_{+1}$, $a'_{+1}$, $b'_{+1}$, $c'_{+1}$. The 4-wire input B allows circuit 19.1 to receive the pixel data b,c, a′, b′; and the input C from register 16 allows it to receive the pixel data $b^*_{-1}$, $a'^*_{-1}$, the finally converted boundary pixels of the prior line.

As FIG. 5 shows, in the circuit 19.1 a NOR gate 33 has its direct inputs connected from the inputs b and b′ and its inverting inputs connected from the inputs c and a′. The gate 33 is used for detecting the configuration 0110 in the line i, as hereabove mentioned.

A NOR gate 34 has four direct inputs which are connected from the wires labeled $b_1$, $c_1$, $a'_1$ and $b'_1$. The gate 34 is used for detecting the case (1) or (4), as hereabove mentioned.

A NOR gate 35 has two inputs which are connected from the wires $b_1$ and $b'_1$, its inverting inputs being connected from the wires $c_1$ and $a'_1$. The gate 35 is used for detecting the case (2) or the case (5), as hereabove mentioned.

The outputs of the gates 34 and 35 are respectively connected to the two inputs of an OR gate 36 whose output is connected to one input of an AND gate 64. The output of the gate 34 is also connected to the input D of a flip-flop having a reset input R connected from the output of an OR gate 38 of which one input is connected from the control input 39 and another input s connected from the control input 40. In addition, the flip-flop 37 has a 1-set input S connected to the control input 41, an output Q connected to the output wire D, and an output $\bar{Q}$ connected to the output wire E.

Furthermore, as shown in FIG. 5, the circuit 19.1 comprises two computing circuits 42 and 43 for the two above mentioned logical calculations, respectively.

In the circuit 42, an AND gate 44 has two direct inputs which are connected from the wires c′ and $c_1$; an AND gate 45 has three direct inputs which are connected from the wires $a_1$, $b_1$, $c_1$ and an inverting input which is connected from the wire $c'_1$. An AND gate 46 has one direct input which is connected from the wire $c_1$ and an inverting input which is connected from the wire $b_1$ and an inverting input from the wire $b_1$. An AND gate 47 has one direct input which is connected from the wire $c_1$. An AND gate 48 has one direct input which is connected from the wire $a'_1$ and three inverting inputs which are connected from the wires $b_1$, $c_1$ and a. To be noted is that the sign of the subscript or index 1 has not been specified hereabove, the sign being negative or positive according to the condition of the flip-flop 37.

The outputs of the AND gates 44 and 47 are connected to the two inputs of an OR gate 49. The outputs of the AND gates 45, 46 and 47 are connected to the three inputs of an OR gate 50. The output of the OR gate 49 is connected to the direct input of an AND gate 51 of which the inverting inputs are connected from the wires $a'_1$ and $b'_1$. The outputs of the AND gates 48, 51 and 52 are connected to three inputs of an OR gate 53.

In the circuit 43, an AND gate 54 has two direct inputs which are connected from the wires a and $a'_1$. An AND gate 55 has three direct inputs which are connected from the the wires $a'_1$, $b'_1$, $c'_1$, and an inverting input which is connected from the wire $a_1$; an AND gate 56 has a direct input which is connected from the wire $b'_1$ and an inverting input is connected from the wire $a'_1$. An AND gate 57 has its direct input connected from the wire $a'_1$ and its inverting input connected from the wire $b'_1$. An AND gate 58 has a direct input connected from the wire $c_1$ and three inverting inputs connected from the wires $a'_1$, $b'_1$, c′.

The outputs of the AND gates 54 and 56 are connected to two inputs of an OR gate 59. The outputs of the AND gates 55, 56 and 57 are connected to three inputs of an OR gate 60. The output of the OR gate 59 is connected to the direct input of an AND gate 61 of which the inverting inputs are connected from the wires $b_1$ and $c_1$. The output of the OR gate 60 is connected to a direct input of an OR gate 62 of which the other two direct inputs are connected from the wires $b_1$ and $c_1$. The outputs of the AND gates 58, 61 and 62 are connected to three inputs of an OR gate 63.

The output of the OR gate 36 is connected to one input of an AND gate 64, of which the other input is connected from the output Q of the flip-flop 37. The output of gate 64 is connected to the first inputs of the OR gates 65 and 66. Each of those OR gates has an enabling input which is connected from the output of the NOR gate 33. The output of the NOR gate 35 is also connected to one input of an AND gate 67, of which the other input is connected from the output $\overline{Q}$ of the flip-flop 37. The output of gate 67 is connected to the first inputs of two AND gates 68 and 69. The second inputs of the gates 68 and 69 are respectively connected from the wires $a'_{-1}$ and $b'_{-1}$ of the input C. The outputs of gates 68 and 69 are respectively connected to the middle inputs of the OR gates 65 and 66. The third inputs of the gates 65 and 66 are respectively connected from the outputs of the OR gates 53 and 63.

When the configuration $bca'b'=0110$ does not appear in a line i, the OR gates 65 and 66 are inhibited so that the circuit 19.1 is unoperative. However, when $bc\ a'\ b'=0110$, the circuit 19.1 is used for determining the converted pixels $\hat{b}$ and $\hat{a}'$ of the line i. In the described embodiment, the circuit 19.1 computes regardless of the state of the output of gate 33, which is only used for determining if the calculations will be used.

For each line i (i not equal to 1) written in the register 9 for conversion (FIG. 1), the flip-flop 37 of FIG. 5 is reset by signals appearing on wires 39 and 40. Therefore, the output $\overline{Q}$ is at "1", so that the signals transferred to circuit 19.1 are the signals which are in the registers 9 (current line) and 10 (prior line). Otherwise stated, the index 1 of the inputs of circuits 42 and 43 is equal to $-1$ (prior line), and the formulas I and II above are applicable. The output condition of the NOR gate 34 indicates by a "1" if it is the Case (1). The condition of the gate 35 indicates by a "1" if it is the Case 2). The combined conditions of the two gates (both outputting "0") indicate if it is the Case (6). Therefore, based on the prior line three operating modes can be entered:

Case 1: The input D of the flip-flop 37 is set to 1 by gate 34, so that its output Q goes to 1. As a result, the incoming signals become those of the registers 8 (next line) and 9 (current line). Therefore, the line $(i+1)$ is analyzed together with the line i. The three cases (4), (5), (6) may arise:

case 4: The output of gate 34, and therefore of gate 36, is at 1 and the port Q of flip-flop 37 is at 1. As a result, the output of the AND gate 64 is at 1, as well as the outputs $\hat{b}$ and $\hat{a}'$. The converted pixels are further converted during the phase 2 to $\hat{b}=\hat{a}'=1$.

case 5: The output of gate 35 and, therefore, of gate 36 is at 1, and the the output Q of flip-flop 37 is at 1. As a result, the output of the AND gate 64 is at 1. A result is that the outputs $\hat{b}$ and $\hat{a}'$ are at 1. The converted pixels are further converted during the phase 2 to $\hat{b}=\hat{a}'=1$.

case 6: The outputs of gates 34 and 35 are both at 0, as are gates 64, 68 and 69. Therefore, the pixels calculated by circuits 43 and 42 pass through the gates 66 and 65. The pixels converted during the phase 1 are further modified accordingly. "Next line" formulae I' and II" apply.

Case 2: The output of gate 35 is at 1 and the output $\overline{Q}$ of flip-flop 37 is at 1. Therefore the output of the AND gate 67 is at 1. The AND gates 68, 69 transfer the prior line data of the finally converted pixels $\hat{b}_{-1}$ and $\hat{a}'_{-1}$, which take the place of the tentatively pixels converted during Phase 1.

Case 3: The pixels of the first line to be converted are written into the register 9 (FIG. 1). The 1-set input 41 FIG. 5) of flip-flop 37 is enabled, so that the output Q of the flip-flop 37 is at 1. As a result, the incoming signals are immediately those of the registers 8 and 9. The three cases (4), (5), (6) may then arise.

Case 4: The operating mode is as described for the Case (1) hereabove.

Case 5: The output of gate 35 (and hence gate 36) and output Q of flip-flop 37 are at 1. Therefore, the output of the AND gate 64 is at 1. This case is then identical to the case (4) hereabove.

case 6: The outputs of both gates 34 and 35 are at 1. The result is as for the case (6) as explained hereabove.

case 6: This case has already been described. The converted pixels are those calculated by circuits 42 and 43 using "prior line" formulas I and II.

The time base or logical control 12 (FIGS. 1, 2*c*) comprises a 4-stage counter 121 of which the input C receives the bit clock signal that it also delivers from its output H. On the other hand, the outputs QA, QB, QC and QD are respectively connected to the first two inverting inputs, the third non-inverting input and the fourth inverting input of a NOR gate 122. The output of the gate 122 and the output H of counter 121 are connected to the inputs of an AND gate 123, of which the output is connected to the clock inputs of the registers 8, 9 and 10 (FIG. 1). Furthermore, the outputs QA, QB, QC and QD are respectively connected to the first non-inverting input and the other three inverting inputs of a NOR gate 124. The output of the gate 124 and the output H of counter 121 are connected to the inputs of the gate 125 of which the output is connected to the clock inputs of the registers 14 (FIG. 2*c*), 15 and 16 (FIG. 2*d*).

The outputs QD and H of counter 121 are also connected to the outputs of an AND gate 126, of which the output is connected to the clock inputs of the registers 14–16.

The clock circuit 12 comprises another counter 127, of which the input C receives the bit clock signal and the output H' delivers clock signals. The outputs QA, QB, QC and QD of the counter 127 are, on the one hand, respectively connected to the first inverting input and the other three non-inverting inputs of a NOR gate 128. On the other hand, these outputs are respectively connected to the first non-inverting input, the second inverting input, and the other two non-inverting inputs of a NOR gate 129. The output of the gate 128 delivers input signals to the gates 30 and 31 of the circuits 13.1–13.4 (FIG. 2*c*).

The outputs of the gates 128 and 129 deliver the signals 40 and 41 to the circuits 19.1–19.2 (FIGS. 2*c* and 2*d*).

A converter circuit $8\times10$ is shown FIG. 9. It comprises an 8-stage shift register 130 of which the data input receives the line pixel bits of a $8\times10$ dot matrix. Its outputs "1" and "2" are respectively connected to the inputs of an OR gate 131. On the other hand, the circuit comprises a 12-stage shift register 132 which delivers the line pixel bits of a $12\times10$ dot matrix. The output "1" of register 130 is connected to the parallel input "1" of register 132, the output of the gate 131 is connected to the parallel input "2" of register 132, and the output "2" of register 130 is connected to the parallel input "3" of the register 132. The same structure is repeated three times and successively for the outputs "3" to "8" of 130 and the inputs "4" to "12" of register 132.

I claim:

1. The system for transcoding in two phases the signals of a 12×10 dot matrix into signals of an 8×10 dot matrix, wherein the transcoding system comprises first means operating in a first phase for arranging initial pixels of each line in said 12×10 matrix in groups of three, the arranged pixels remaining in their natural order, and for logically processing each group of three initial pixels to obtain a group of two converted pixels; and second means operating in a second phase and having analyzing means for analyzing an initial four pixel boundary block which spans an interspace boundary between two adjacent three pixel groups, and calculating means which is responsive to said analyzing means and which (i) is effective when the boundary block is different from 0110 for retaining as final a corresponding converted block of two boundary pixels converted in the first phase, said two pixels being those which are on either side of the interspace boundary, and (ii) which is effective when said four pixel boundary block is 0110 for analyzing the configuration of the initial four pixel boundary block belonging to the last previous line to revise the converted block;

said calculating means including:

(a) means responsive to said boundary block of the previous line being 0110 for replacing the pixels of the converted block with the corresponding finally converted pixels of the last previous line.

(b) means responsive to the previous line's boundary block being neither 0110 nor 0000 for calculating first substitute pixels in response to the initial pixels in the current line and in the last previous line which are most closely related, and for replacing the pixels of the converted block by the first substitute pixels, and (c) means responsive to the previous line's boundary block being equal to 0000 for analyzing the corresponding initial four pixel boundary block in the next succeeding line, and responsive to said analysis when the next line's boundary block is equal to 0000 or 0110 for replacing the two adjacent boundary pixels of the converted block by 1 and 1, and means responsive to said analysis when said boundary block of the next line is neither 0000 nor 0110 for calculating second substitute pixels in response to the initial pixels in the current line and in the next succeeding line which are most closely related, and for replacing the pixels of the converted block by the second substitute pixels.

2. The system according to claim 1 wherein the logical processing means of the first phase convert the initial three pixels a, b, c, into a group of converted pixels $\hat{a}$, $\hat{b}$, according to the following logical formula:

$$\hat{a}=a+(\bar{b}_{-1}\cdot a_{-1}+\bar{c}_{-1}\cdot b_{-1})\cdot\bar{a}\cdot b\cdot\bar{c}$$

$$\hat{b}=c+(c_{-1}\cdot b_{-1}+\bar{b}_{-1}\cdot\bar{a}_{-1})\cdot\bar{a}\cdot b\cdot\bar{c}.$$

3. The system according to claim 1 wherein the first substitute pixels b and a' for the converted block are calculated in response to initial pixels a, c, a', c' in the current line and initial pixels $a_{-1}$, $b_{-1}$, $c_{-1}$, $a'_{-1}$, $b'_{-1}$, $c'_{-1}$ in the last previous line by said means for calculating first substitute pixels according to the two following logical equations:

$$\hat{b}\cdot\hat{a}'=a'_{-1}\cdot b'_{-1}\cdot(a_{-1}\cdot b_{-1}\cdot c_{-1}\cdot\bar{c}'_{-1}+\bar{b}_{-1}\cdot c_{-1}+b_{-1}\cdot\bar{c}_{-1})+\bar{a}'_{-1}\cdot\bar{b}'_{-1}\cdot(c_{-1}\cdot c'+b_{-1}\cdot\bar{c}_{-1})+\bar{b}_{-1}\cdot\bar{c}_{-1}\cdot a'_{-1}\cdot\bar{a}$$

and $$\hat{b}\cdot\hat{a}'=b_{-1}\cdot c_{-1}\cdot(\bar{a}_{-1}\cdot a'_{-1}\cdot b'_{-1}\cdot c'_{-1}+a'_{-1}\cdot\bar{b}'_{-1}+\bar{a}'_{-1}\cdot b'_{-1})+\bar{b}_{-1}\cdot\bar{c}_{-1}\cdot(a'_{-1}\cdot a+\bar{a}'_{-1}\cdot b'_{-1})+c_{-1}\cdot\bar{a}'_{-1}\cdot\bar{b}'_{-1}\cdot\bar{c}'.$$

4. The system according to claim 1 wherein the second substitute pixels $\hat{b}$ and $\hat{a}'$ for the converted block are calculated in response to initial pixels a, c, a', c', in the current line and initial pixels $a_{+1}$, $b_{+1}$, $c_{+1}$, $a'_{+1}$, $b'_{+1}$, $c'_{+1}$, in the next succeeding line by said means for calculating second substitute pixels according to the two following logical equations:

$$\hat{b}\cdot\hat{a}'=a'_{+1}\cdot b'_{+1}\cdot(a_{+1}\cdot b_{+1}\cdot c_{+1}\cdot\bar{c}'_{+1}+\bar{b}_{+1}\cdot c_{+1}+b_{+1}\cdot\bar{c}_{+1})+\bar{a}'_{+1}\cdot\bar{b}'_{+1}\cdot(c_{+1}\cdot c'+b_{+1}\cdot\bar{c}_{+1})+\bar{b}_{+1}\cdot\bar{c}_{+1}\cdot a'_{+1}\cdot\bar{a}$$

and $$\hat{b}\cdot\hat{a}'=b_{+1}\cdot c_{+1}\cdot(\bar{a}_{+1}\cdot a'_{+1}\cdot b'_{+1}\cdot c'_{+1}+1+a'_{+1}\cdot\bar{b}'_{+1}+\bar{a}'_{+1}\cdot b'_{+1})+\bar{b}_{+1}\cdot\bar{c}_{+1}\cdot(a'+1\cdot a+\bar{a}'_{+1}\cdot b'_{+1})+c_{+1}\cdot\bar{a}'_{+1}\cdot\bar{b}'_{+1}\cdot\bar{c}'.$$

5. The system of any one of the claims 1–4 wherein said system includes first, second, and third serially mounted 12-stage shift register means for storing initial pixel signals of successive lines of the 12×10 dot matrix, each having a plurality of parallel outputs; said first means include first phase logical processing means having a plurality of inputs connected to corresponding outputs of the first and second 12-stage shift register means and a plurality of outputs for converted pixel signals, and first 8-stage shift register means having parallel inputs connected to corresponding outputs of the first phase processing means for receiving the converted pixel signals; and said second means include second phase logical processing means having a plurality of inputs preselected ones of which are connected to corresponding outputs of the second 12-stage shift register, OR gate means, the parallel outputs of the first and third 12-stage shift register means being connected to corresponding inputs of the second phase processing circuit means through said OR gate means, third 8-stage shift register means having a plurality of parallel outputs, all of which except the first one and the last one are connected to corresponding inputs of the second phase processing means, and second 8-stage shift register means coupled in series between said first and third 8-stage shift register means and having parallel inputs, all of which except for the first input and the last input are connected to the outputs of the second phase processing means for receiving revised boundary pixel signals of the 8×10 dot matrix; and said system includes time base means for controlling the operation of the first and second phase processing means and for clocking the 12-stage and 8-stage shift register means.

6. A transcoding circuit for transcoding pixel signals of a 12×10 dot matrix into pixel signals of an 8×10 dot matrix, said transcoding circuit comprising first, second, and third series connected 12-stage shift registers for respectively storing pixel signals of successive lines of the 12×10 matrix and having parallel outputs, the first 12-stage shift register having a serial input for receiving the pixel signals of a line of the 12×10 matrix; first calculating means having inputs coupled and responsive to corresponding parallel outputs of the first and second 12-stage shift registers for tentatively calculating the pixel signals of a line of the 8×10 matrix; first, second, and third series connected 8-stage shift registers, the first and second 8-stage shift registers having parallel input terminals and the first calculating means having parallel outputs connected to corresponding parallel inputs of the first 8-stage shift register; second calculating means having parallel inputs connected to corresponding parallel outputs of the second 12-stage shift register and having parallel outputs connected to corresponding inputs of said second 8-stage shift register; OR gate means for selectively coupling the parallel outputs of the first and third 12-stage shift registers to corresponding inputs of the second calculating means; said second calculating means being responsive to selected outputs of the first, second, and third 12-stage shift registers for tentatively calculating the pixel signals of a line of the $8 \times 10$ matrix; and clock means for governing the functioning of the first and second calculating means and the 12-stage and 8-stage shift registers.

7. The transcoding circuit according to claim 6 wherein the outputs of the first and second 12-stage shift registers are grouped into threes in order to form four successive groups and the inputs of the first 8-stage shift register are grouped into twos also in order to form four successive groups, the first calculating means comprising three first logical calculation circuits, each first logical calculation circuit having three first inputs which are connected to three outputs of a corresponding group of the first 12-stage shift register, and three second inputs connected to three outputs of a corresponding group and rank of the second 12-stage shift register, and a set of logical gates connected to inputs of a corresponding group and rank of the first 8-stage shift register.

* * * * *